US009371968B2

(12) United States Patent
Kuhn et al.

(10) Patent No.: US 9,371,968 B2
(45) Date of Patent: Jun. 21, 2016

(54) LIGHTING DEVICE

(75) Inventors: Gerhard Kuhn, Koefering (DE); Ales Markytan, Regensburg (DE); Christian Gaertner, Regensburg (DE)

(73) Assignee: OSRAM GMBH, Munich (DE)

( * ) Notice: Subject to any disclaimer, the term of this patent is extended or adjusted under 35 U.S.C. 154(b) by 270 days.

(21) Appl. No.: 14/111,581

(22) PCT Filed: Apr. 12, 2012

(86) PCT No.: PCT/EP2012/056688
§ 371 (c)(1),
(2), (4) Date: Dec. 30, 2013

(87) PCT Pub. No.: WO2012/140146
PCT Pub. Date: Oct. 18, 2012

(65) Prior Publication Data

US 2014/0104829 A1 Apr. 17, 2014

(30) Foreign Application Priority Data

Apr. 15, 2011 (DE) ..... 10 2011 017 195

(51) Int. Cl.
*F21K 99/00* (2016.01)
*F21Y 101/02* (2006.01)
(Continued)

(52) U.S. Cl.
CPC ... *F21K 9/30* (2013.01); *F21S 4/28* (2016.01); *F21V 7/005* (2013.01); *F21Y 2101/02* (2013.01); *F21Y 2103/003* (2013.01); *F21Y 2113/005* (2013.01)

(58) Field of Classification Search
CPC ..... F21K 9/30; F21S 4/008
USPC ..... 362/225, 249.02
See application file for complete search history.

(56) References Cited

U.S. PATENT DOCUMENTS 7,690,813 B2 * 4/2010 Kanamori ..... F21K 9/00 361/704
7,819,567 B2 10/2010 Graham
(Continued)

FOREIGN PATENT DOCUMENTS

AT 10993 U2 2/2010
AT 10996 U2 2/2010
(Continued)

OTHER PUBLICATIONS

Chinese Office Action based on the application No. 2012800184324 (5 pages of English translation) dated Feb. 4, 2015.
(Continued)

*Primary Examiner* — Anabel Ton
(74) *Attorney, Agent, or Firm* — Viering, Jentschura & Partner mbB

(57) ABSTRACT

A lighting device may include: a rod-shaped carrier body with at least one first and one second mounting side and a main direction of extent, first semiconductor light-emitting elements on first mounting faces of the first mounting side, and second semiconductor light-emitting elements on second mounting faces of the second mounting side, wherein the first and the second mounting sides face away from one another, wherein the mounting faces are formed by depressions in the mounting sides, which depressions are arranged so as to be spaced apart along the main direction of extent, and wherein the first semiconductor light-emitting elements are identical to one another and the second semiconductor light-emitting elements are identical to one another.

19 Claims, 2 Drawing Sheets

(51) Int. Cl.

| | |
|---|---|
| *F21V 7/00* | (2006.01) |
| *F21Y 103/00* | (2016.01) |
| *F21Y 113/00* | (2016.01) |

(56) References Cited

U.S. PATENT DOCUMENTS

| | | | |
|---|---|---|---|
| 2005/0207156 | A1 | 9/2005 | Wang et al. |
| 2005/0265019 | A1 | 12/2005 | Sommers et al. |
| 2006/0256557 | A1 | 11/2006 | Kanamori et al. |
| 2007/0159828 | A1 | 7/2007 | Wang |
| 2010/0103659 | A1 | 4/2010 | Chen |
| 2011/0019421 | A1 | 1/2011 | Lai |
| 2011/0058372 | A1 | 3/2011 | Lerman et al. |
| 2011/0063838 | A1 | 3/2011 | Dau et al. |
| 2011/0073883 | A1 | 3/2011 | Osawa et al. |
| 2011/0075416 | A1 | 3/2011 | Chou et al. |

FOREIGN PATENT DOCUMENTS

| | | | |
|---|---|---|---|
| CN | 1865764 | A | 11/2006 |
| CN | 101963292 | A | 2/2011 |
| DE | 19921684 | A1 | 11/2000 |
| DE | 20013605 | A1 | 2/2001 |
| DE | 202010001127 | U1 | 9/2010 |
| DE | 202010017009 | U1 | 3/2011 |
| FR | 2912204 | A1 | 8/2008 |
| GB | 2446470 | A | 8/2008 |
| JP | 2002-197901 | A | 7/2002 |
| WO | 2008078077 | A1 | 7/2008 |

OTHER PUBLICATIONS

International Search Report of PCT/EP2012/056688 dated Jul. 19, 2012.

* cited by examiner

LIGHTING DEVICE

RELATED APPLICATIONS

This application is a national stage entry according to 35 U.S.C. §371 of PCT application No.: PCT/EP2012/056688 filed on Apr. 12, 2012, which claims priority from German application No.: 10 2011 017 195.9 filed on Apr. 15, 2011.

TECHNICAL FIELD

In the following a lighting device is specified.

SUMMARY

Various embodiments specify a lighting device which can emit light in different directions during operation.

In accordance with at least one embodiment, a lighting device has a carrier body. The carrier body can be in particular rod-shaped, which means that the carrier body has an elongate form with a main direction of extent, wherein the dimensions of the carrier body along the main direction of extent are greater, preferably a multiple greater, than the dimensions perpendicular to the main direction of extent.

In accordance with at least one embodiment, the carrier body has at least one first and one second mounting side. The mounting sides extend along the main direction of extent of the carrier body, wherein first mounting faces are formed on the first mounting side and second mounting faces are formed on the second mounting side. In particular, each of the mounting sides has a plurality of mounting faces.

In accordance with a further embodiment, the mounting faces of each mounting side are arranged along the main direction of extent. In particular, the mounting faces can each be arranged spaced apart from one another along the main direction of extent.

In accordance with a further embodiment, the lighting device has first semiconductor light-emitting elements on the first mounting faces of the first mounting side. Furthermore, the lighting device in accordance with a further embodiment has second semiconductor light-emitting elements on the second mounting faces of the second mounting side.

In accordance with a further embodiment, each of the mounting faces is formed by a depression in the respective mounting side. In particular, this can mean that the first mounting faces are formed on the first mounting side as depressions arranged spaced apart from one another along the main direction of extent, and the second mounting faces are formed as depressions in the second mounting side, which depressions are arranged spaced apart along the main direction of extent.

In accordance with a further embodiment, each of the mounting faces is at least partially planar. In particular, each of the mounting faces can be in the form of a depression with a planar base. Furthermore, each mounting face can be envisaged such that one or more semiconductor light-emitting elements can be mounted and electrically connected on said mounting face. Each of the mounting faces has a surface normal, which can correspond in particular to a main emission direction of the respectively mounted semiconductor light-emitting element. Particularly preferably, the first mounting faces are arranged parallel to one another and in one plane, in particular with respect to the planar bases. Furthermore, the second mounting faces are particularly preferably arranged parallel and in one plane, with respect to the planar bases.

In accordance with a further embodiment, the first and second mounting sides face away from one another. This can mean in particular that the surface normals of the first mounting faces enclose an angle with the surface normals of the second mounting faces which is greater than or equal to 90°. Here and in the following, always the smaller of the two angles enclosed by in each case two surface normals is assumed to be the angle between the surface normals.

In accordance with a further embodiment, the carrier body is designed as a heat sink for the semiconductor light-emitting elements mounted thereon. This can mean in particular that the material, the dimensions and the mass of the carrier body are selected such that the heat generated by the operation of the semiconductor light-emitting elements can be dissipated such that permanent operation of the semiconductor light-emitting elements and therefore of the lighting device is possible. In particular, the carrier body can be formed from metal, for example aluminum and/or copper, or at least contain such a metal.

In accordance with a further embodiment, the carrier body is in the form of a rod with a partially round profile or in the form of a plate, i.e. with a rectangular profile.

In accordance with a further embodiment, the carrier body has at least two rod-shaped body parts, each having a partially round cross section. Each of the at least two rod-shaped body parts has a flattened side in the form of a flattened side face, which runs along the main direction of extent of the carrier body or of each body part and by means of which the body parts are arranged against one another. The carrier body can in this case be formed integrally or else in a plurality of parts. Each of the body parts can have, for example, a half-round cross-sectional profile, for example in the form of a semicircle or half an ellipse, with the result that the carrier body, after assembly of two rod-shaped body parts, forms a rod with a round cross section. If the carrier body has more than two body parts, each body part can have, for example, a section in the form of a sector of a circle or an ellipse, with the result that the body parts, once assembled, likewise again form a circular or elliptical cross section for the carrier body. Furthermore, the cross section of a body part can have, for example, a round, for instance a circular, cross section, from which a segment of a circle or another region has been removed, with the result that the body part has at least one flattened side. The carrier body which has at least two such body parts can thus have a cross section which is dumbbell-shaped or whose outer circumferential line has the shape of a figure eight or is at least reminiscent of a figure eight. If the carrier body has, for example, three body parts, the cross section of the carrier body can be in the form of a cloverleaf.

In accordance with a further embodiment, the first and second semiconductor light-emitting elements are suitable for emitting light in a wavelength range of ultraviolet radiation to infrared radiation, particularly preferably of visible light. In this case, one or more of the semiconductor light-emitting elements can emit monochrome light or else mixed light, particularly preferably white light. A semiconductor light-emitting element can have, for this purpose, a light-emitting semiconductor layer sequence with a wavelength conversion element in the form of a layer of phosphor, a phosphor platelet or a phosphor-containing casting compound being arranged downstream of said semiconductor layer sequence, which wavelength conversion element can convert at least some of the radiation generated by the semiconductor layer sequence into light having a different wavelength, with the result that the semiconductor light-emitting element can emit mixed light. The semiconductor light-emitting elements can in particular be in the form of epitaxially grown semiconductor layer sequences or can each have an epitaxially grown semiconductor layer sequence. The semiconductor layer sequence can in particular be configured as a semiconductor chip. The semiconductor layer sequence can comprise an arsenide, phosphide and/or nitride compound semiconductor material, which is designed corresponding to the desired light in terms of its composition and in terms of its layer structure. One or more semiconductor light-emitting elements can be in particular in the form of light-emitting diodes (LEDs). For this purpose, a semiconductor light-emitting element can have, for example, a housing body into which the epitaxially grown semiconductor layer sequence, i.e. the semiconductor chip, is mounted and possibly embedded in a casting material. As an alternative to this, one or more semiconductor light-emitting elements can also be mounted as epitaxially grown semiconductor layer sequences in the form of semiconductor chips directly on the carrier body without a respective housing body.

In accordance with a further embodiment, the first semiconductor light-emitting elements are identical to one another. In accordance with yet a further embodiment, the second semiconductor light-emitting elements are identical to one another. By virtue of identical semiconductor light-emitting elements on one mounting side, the lighting device can emit light of the same color over the entire mounting side in question, for uniform illumination.

In accordance with a further embodiment, the first semiconductor light-emitting elements emit light which is different from the light emitted by the second semiconductor light-emitting elements.

In accordance with a further embodiment, the first semiconductor light-emitting elements are intended for the direct illumination of an object or a working area, while the second semiconductor light-emitting elements are intended for indirect illumination of the room or the environment in which the lighting device is located. As a result, the lighting device can be used simultaneously as direct and indirect lighting, wherein the respectively emitted light intensities can be adjustable and controllable independently of one another for direct and indirect lighting.

In contrast to the present lighting device, direct and indirect lighting are usually achieved in known light sources by virtue of the fact that a light source with separate optical paths or two optically separate light sources are used. Since in each case a different emission characteristic is desired for indirect and direct lighting, in known light sources further optical components are required, for which reason a compact design can no longer be achieved.

In accordance with a further embodiment, the lighting device has exactly one light-emitting semiconductor chip as first semiconductor light-emitting elements in each depression of the first mounting face. In particular, each semiconductor chip, as described above, can be provided with a wavelength conversion element, with the result that each of the first semiconductor light-emitting elements can preferably emit cold-white light during operation, which can be particularly suitable for direct lighting.

In accordance with a further embodiment, each of the second semiconductor light-emitting elements has exactly one light-emitting semiconductor chip in each depression in the second mounting face, which semiconductor chip, as described above, can be combined with a wavelength conversion element, with the result that the second semiconductor light-emitting elements can particularly preferably emit warm-white light, which can be particularly suitable for indirect lighting.

In accordance with further embodiments, the first semiconductor light-emitting elements and/or the second semiconductor light-emitting elements each have a plurality of light-emitting semiconductor chips. The respective plurality of light-emitting semiconductor chips can have no housing, can be arranged in a common housing or can be arranged in separate housings as respective semiconductor light-emitting element. In particular, the respective plurality of light-emitting semiconductor chips can comprise a plurality of semiconductor chips of different colors, particularly preferably the combination of a red, a green or a whitish-green and a blue-emitting semiconductor chip. In addition or as an alternative, semiconductor chips emitting other colors and/or semiconductor chips in combination with wavelength conversion elements can also be provided. By combining a plurality of light-emitting semiconductor chips for a semiconductor light-emitting element, the light color on the first and/or second mounting side of the lighting device can be varied and controlled in a targeted manner during operation, with the result that, for example, a lighting effect with different colors, temporally changing colors and/or a variable white light, for example along the white light curve of Planckian black body radiator known to a person skilled in the art, is adjustable.

In accordance with a further embodiment, each mounting face has electrical connections for a semiconductor light-emitting element arranged on the mounting face. Such connections can be provided, for example, in the form of electrical contact faces, solder contacts and/or plug-type contacts. Electrical feed lines which interconnect, for example, the mounting faces on one mounting side can run as conductor tracks or cables along the surface or alternatively also in the interior or in a combination thereof along the main direction of extent of the carrier body.

In accordance with a further embodiment, the carrier body has in each case one printed circuit board on the mounting faces, wherein the semiconductor light-emitting elements are each arranged, mounted and electrically connected on a printed circuit board. In particular, the semiconductor light-emitting elements may be in the form of surface-mountable semiconductor light-emitting elements, which are soldered onto the printed circuit boards on the mounting faces. In this case, each mounting face can have a dedicated printed circuit board, which are interconnected via conductor tracks and/or cable connections, for example over the interior of the carrier body. As an alternative to this, a continuous printed circuit board can be provided on each mounting side, which printed circuit board extends along the main direction of extent of the carrier body and protrudes through in each case one subregion of the carrier body, for example between the mounting faces.

In accordance with a further embodiment, the depressions forming the mounting faces have reflective side faces. Particularly preferably, the side faces can be reflective in mirrored or specular fashion.

In accordance with a further embodiment, the side faces of a depression are formed perpendicular to the respective mounting face. As a result, a high degree of compactness of the lighting device can be achieved. As an alternative to this, the depressions can also have angled side faces, with the result that it may be possible to deflect light emitted laterally from the semiconductor light-emitting elements in the direction of the main emission direction of the respective semiconductor light-emitting element.

The depressions can be identical or different on the at least two mounting sides. The depressions in one mounting side, i.e. the first and/or the second mounting side, can particularly preferably be identical. By virtue of the different embodiment of depressions, for example by virtue of a formation of different depressions in the first mounting side in comparison with the second mounting side, the desired emission characteristics can be adjusted independently of one another for the mounting sides.

In accordance with a further embodiment, the semiconductor light-emitting elements are at least partially or else entirely sunk into the mounting faces formed by the depressions. In particular, the depressions of the first mounting faces can have a shape, width and depth such that light which is emitted by the first semiconductor light-emitting elements can only be emitted at an angle of less than or equal to 65° and preferably of less than or equal to 45° with respect to the surface normal of the respective mounting face during operation. The angle specified here corresponds to the angle measured with respect to the main emission direction, which also corresponds to the angle with respect to the surface normal of the mounting face. For light which is emitted at a greater angle by the semiconductor light-emitting elements, the depressions or the side faces of the depressions act as a form of shading, or if these depressions or side faces are reflective, act as reflectors which can deflect the light in the direction of the main emission direction, for example.

In accordance with a further embodiment, the depressions in the second mounting faces have a shape, width and depth such that all of the light emitted by the second semiconductor light-emitting elements is emitted directly. This can mean in particular that the depth is selected together with the width and the shape of the depressions of the second mounting faces such that the depressions and in particular the side faces of the depressions do not shade light.

In accordance with a further embodiment, the depressions in the second mounting face are embodied such that they have a shape, width and depth so that light can be emitted at an angle of less than or equal to 90° with respect to the main emission direction of the respective mounting face or with respect to the surface normal of the respective mounting face during operation.

Such emission characteristics or emission angles are suitable, in the case of the depressions in the first mounting side, in particular for direct lighting and, in the case of the second mounting side, for indirect lighting.

In accordance with a further embodiment, the mounting faces of a mounting side are arranged spaced apart from one another at a respectively equal distance along the main direction of extent. Here and in the following, the distance between two adjacent mounting faces is understood to mean the distance between the respective center points. In particular, the mounting faces and/or the second mounting faces can each be arranged spaced uniformly apart along the main direction of extent of the carrier body. Particularly preferably, the distance between two directly adjacent mounting faces is at least 2 cm.

In accordance with a further embodiment, the distances between the first mounting faces are equal to the distances between the second mounting faces, wherein the first and second mounting faces are arranged offset with respect to one another. Particularly preferably, the first mounting faces can be arranged on the first mounting side and the second mounting faces can be arranged on the second mounting side, offset with respect to one another by half the distance. By virtue of an offset arrangement of the respective mounting faces on the first and second mounting sides with respect to one another, more uniform heat distribution of the heat produced during operation of the device can be achieved, which can have an advantageous effect on the total heat and the operating temperature of the lighting device and the individual semiconductor light-emitting elements.

In accordance with a further embodiment, the semiconductor light-emitting elements of the first and/or second mounting sides are arranged in different positions with respect to one another on the respective mounting faces. This can mean in particular that the arrangement of the semiconductor light-emitting elements on the mounting faces on one mounting side is not uniform, but is an asymmetrical arrangement, as a result of which a different distance with respect to the respective side faces can be achieved in each case in the mounting faces formed by depressions. As a result, depending on the shape and alignment of the side faces, in each case a different emission direction or a different emission cone of the semiconductor light-emitting elements can be achieved, as a result of which different emission characteristics of the first and/or second mounting side of the lighting device can be achieved.

In accordance with a further embodiment, the carrier body has at least one third mounting side with third semiconductor light-emitting elements on third mounting faces which are formed by depressions and are arranged along the main direction of extent. The first, second and third mounting sides are in this case each arranged so as to face away from one another. In particular, the surface normals of the second and third mounting faces can be formed so as to be symmetrical with respect to that plane in which the surface normals of the first mounting faces lie. The surface normals of the second and/or third mounting faces preferably each enclose an angle of greater than or equal to 90° and less than or equal to 135° with the surface normals of the first mounting faces. If it is assumed that the surface normals of the first mounting faces with an exemplary alignment of the lighting device point perpendicularly downwards in three dimensions, this means that the surface normals of the second and third mounting sides are each particularly preferably directed at an angle of greater than or equal to 0° and less than or equal to 45° with respect to the horizontal. This results in a corresponding main emission direction for the second and third semiconductor light-emitting elements. Furthermore, the first, second and third mounting sides can be arranged uniformly with respect to the respective angle enclosed between the surface normals, with the result that the respective surface normals each enclose an angle of approximately 120° with one another.

In accordance with a further embodiment, the second and third semiconductor light-emitting elements are identical. In particular, the second and third semiconductor light-emitting elements or the second and third mounting sides can be intended for indirect lighting, where the first mounting side and therefore the first semiconductor light-emitting elements can be intended for direct lighting.

That which has been mentioned above in connection with the first and second semiconductor light-emitting elements, mounting faces and depressions therein, in particular that which has been said in connection with the second semiconductor light-emitting elements and the second mounting faces, applies to the third semiconductor light-emitting elements, the third mounting faces and the depressions forming the third mounting faces.

In accordance with a further embodiment, the lighting device has a reflector, which is arranged downstream of the second mounting side in the emission direction of the second semiconductor light-emitting elements. If the lighting device has a third mounting side with third semiconductor light-emitting elements, the reflector can in particular be arranged downstream of the second and third mounting sides in the emission direction of the second and third semiconductor light-emitting elements. "Arranged downstream in the emission direction" can in this case mean in particular that all of the light emitted by the second and possibly also the third semiconductor light-emitting elements falls on the reflector. In particular, the reflector may be in the form of a diffuse reflector, for example, as a result of which good mixing of the respectively emitted light can be produced, for example in conjunction with second and possibly third semiconductor light-emitting elements, which each have a plurality of differently colored semiconductor chips.

In accordance with a further embodiment, the lighting device has one or more diffusers, for example diffusing plates or diffusing films, which are arranged downstream of single or several semiconductor light-emitting elements. For example, each of the depressions in one mounting side or else all mounting sides can be covered individually or else jointly by such a diffuser. Optical diffusers can be used to achieve a uniform and homogeneous emission and, when using differently colored semiconductor chips for the semiconductor light-emitting elements, also uniform mixing and thus a uniform light color of the emitted light over the solid angle.

In accordance with further embodiments, the lighting device can have electrical connections, a holding apparatus such as a lamp base, for example, a suspension fastening and/or a plug. Furthermore, a plurality of lighting devices can be plugged onto one another, with the result that a lighting apparatus of variable length may be possible.

In accordance with a further embodiment, the lighting device described here can be used or is used for general and indirect interior lighting, for example for office lighting, and at the same time as direct spotlighting.

The lighting device described here can in particular meet the following five requirements at the same time, namely no glare, direct and indirect lighting, high luminaire efficiency, utilization factor of the direct lighting and a compact design. This can also advantageously be supplemented in particular by virtue of the fact that surface-mountable semiconductor light-emitting elements such as, for example, surface-mountable light-emitting diodes are used as light sources. In particular, it may be possible to achieve no glare by virtue of the fact that no additional optical components need to be used. In known light sources, no glare is usually achieved as a result of the use of reflectors, secondary lenses or cover disks, but either the luminance is reduced or the direct viewing contact with the light-emitting means in the light source is avoided. However, all of said components require, in addition to the light source, additional optical components, as a result of which both the luminaire efficiency is reduced and the external dimensions of the luminaire increase. Since the lighting device in accordance with the above-described embodiments preferably has few or no optical elements arranged downstream of the semiconductor light-emitting elements, high luminaire efficiency and a high utilization factor can be achieved in particular for direct lighting. A high or very high luminaire efficiency can always be achieved when the light within the lighting device interacts as little as possible with optical components such as reflectors or lenses, for example, since any interaction is associated with absorption or a transition in the refractive index. In known light sources, such components are necessary, however, since otherwise, as the number of interactions is reduced, the possibility is also reduced of matching the emission characteristic of the known light sources in a desirable manner. By virtue of the special geometric embodiment and arrangement of the semiconductor light-emitting elements on the carrier body, in the lighting device described here such additional components are not necessary for matching the emission characteristic of the lighting device in a desirable manner.

The aims and advantages which can be achieved simultaneously with the lighting device described here can thus not be achieved simultaneously with light sources from the prior art since the objectives at least sometimes require contradictory technical measures in known light sources.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

In exemplary embodiments and figures, identical or functionally identical component parts can each be provided with the same reference symbols. The elements illustrated and the size ratios thereof with respect to one another should in principle not be considered as being true to scale, but rather individual elements, such as layers, structural parts, structural elements and regions, for example, can be illustrated as being excessively thick or having excessively large dimensions for improved clarity and/or understanding.

Figure 1A:
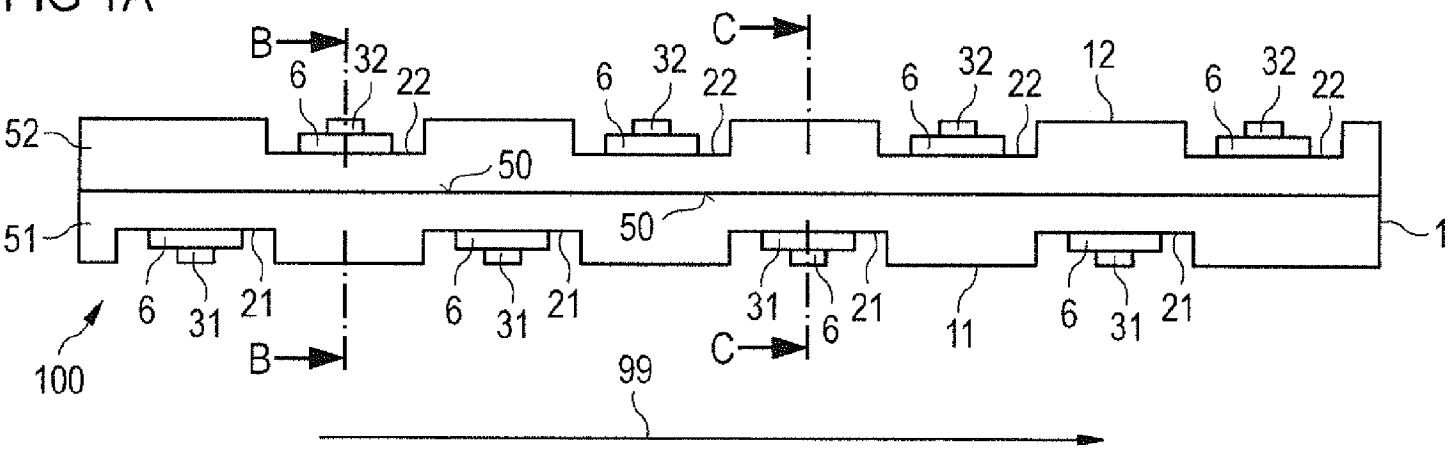
FIGS. 1A to 3B show schematic illustrations of lighting devices in accordance with various exemplary embodiments.
Figure 1C:
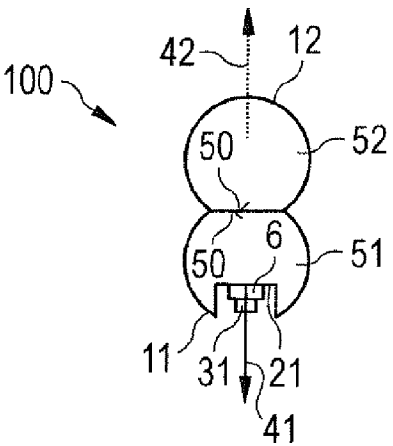
Figure 1B:
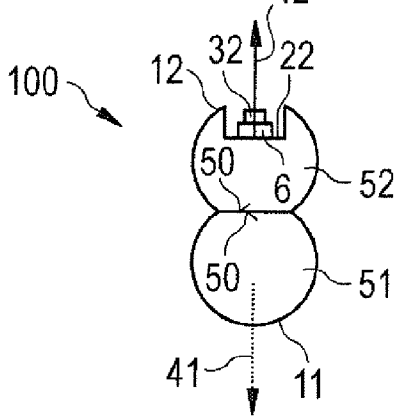

FIGS. 1A to 1C show a lighting device 10 in accordance with an exemplary embodiment, wherein FIGS. 1B and 1C are sectional illustrations of the view of the lighting device 100 shown in FIG. 1A along the section planes BB and CC. The description below relates equally to FIGS. 1A to 1C.

The lighting device 100 has a rod-shaped carrier body 1 with a first and a second mounting side 11, 12. The rod-shaped carrier body 1 has a main direction of extent 99, along which first and second semiconductor light-emitting elements 31, 32 are arranged on the first or the second mounting side 11, 12.

As can be seen in particular from FIGS. 1B and 1C, the carrier body 1 is formed from two body parts 51, 52, which each have a partially round cross section. In particular, each body part 51, 52 has a circular cross section, from which a segment of a circle has been removed, with the result that each of the body parts 51, 52 has a flattened side 50 and the body parts 51, 52 are arranged with the flattened sides 50 against one another. Such a carrier body 1 can in this case be produced integrally or else in the form of a multi-part carrier body 1, for example in the form of separate body parts 51, 52. As an alternative to the exemplary embodiment shown, other shapes for the carrier body 1 or the cross section thereof and for the body parts 51, 52 and the cross sections thereof are also possible.

The carrier body 1 is formed from metal, for example aluminum, which has a high thermal conductivity, with the result that the carrier body 1 is at the same time in the form of a heat sink for the semiconductor light-emitting elements 31, 32. On the first and second mounting sides 11, 12, the carrier body 1 has in each case first and second mounting faces 21, 22, which are each formed by depressions and which are arranged spaced apart from one another along the main direction of extent 99. The mounting faces 21, 22 are in particular formed by the bases of the depressions and are planar. In the exemplary embodiment shown, the depressions are each arranged so as to be spaced apart uniformly on each of the mounting sides 11, 12 and so as to be offset by half a distance on the second mounting side 12 in comparison with the first mounting side 11. The distance between two adjacent depressions on the mounting sides in the present exemplary embodiment is at least 2 cm. As a result of this and as a result of the offset arrangement, it is possible to prevent first and second semiconductor light-emitting elements 31, 32 from being arranged directly adjacent to one another, i.e. in particular in an identical cross-section plane, as a result of which the formation of a high level of local development of heat can be avoided.

The first and second mounting sides 11, 12 are arranged so as to face away from one another, wherein the surface normals 41, 42 indicated in FIGS. 1B and 1C of the first and second mounting faces 21, 22 enclose an angle with one another of 180°, as a result of which emission from the first and second semiconductor light-emitting elements 31, 32 in opposite directions is produced.

For the electrical contact-making or for the electrical connection of the semiconductor light-emitting elements 31, 32, said semiconductor light-emitting elements are arranged on printed circuit boards 6 within the depressions. The printed circuit boards 6 can, as described in the general section, be interconnected, with the result that simultaneous driving of the first semiconductor light-emitting elements 31 and simultaneous driving of the second semiconductor light-emitting elements 32 is possible.

Furthermore, the lighting device 100 can have electrical connections and a holding apparatus, for example in the form of a lamp base or a suspension fastening, (not shown), via which at the same time also electrical feed lines can be provided. Furthermore, the lighting device 100 can have, at each of the ends arranged in the main direction of extent 99, connecting elements or plug-type elements (not shown), by means of which, for example, a plurality of lighting devices 100 can also be connected to one another to form a rod-shaped luminaire and can be operated simultaneously.

The lighting device 100 in the exemplary embodiment shown, is formed, purely by way of example, as direct lighting on the first mounting side 11 and as indirect lighting on the second mounting side 12. For this purpose, the lighting device 100 has, purely by way of example, cold-white-emitting light-emitting diodes described in the general part as first semiconductor light-emitting elements 31, while the second semiconductor light-emitting elements 32 are in the form of warm-white-emitting light-emitting diodes. The light-emitting diodes are in this case surface mountable on the printed circuit boards 6, with the result that simple mounting and simple electrical connection of said diodes is provided. As an alternative to this, warm-white-emitting semiconductor light-emitting elements 31 can also be used on the first mounting side 11 and cold-white-emitting semiconductor light-emitting elements 32 on the second mounting side 12. Furthermore, it is also possible, as described in the general part, to use semiconductor light-emitting elements 31, 32, which each have a plurality of semiconductor chips which each emit light of different colors, on at least one mounting side 11, 12, with the result that variable adjustability and controllability of the emitted light or of the light color thereof can be possible.

In particular, it is also possible here for the individual semiconductor light-emitting elements 31, 32 to be in the form of groups of light-emitting diodes, so-called LED clusters, which are formed from a plurality of individual LEDs. In order to achieve uniform emission in respect of light intensity and light color, the first semiconductor light-emitting elements 31 are each identical and the second semiconductor light-emitting elements 32 are each identical. However, the first and second semiconductor light-emitting elements 31, 32 can be different from one another in terms of their physical shape and, as already described, in terms of their emitted light color.

The depressions forming the first and second mounting faces 21, 22 are provided with perpendicular side faces, as a result of which a high degree of compactness of the lighting device 100 can be achieved. In this case, the depressions in the first mounting faces 21 are formed in terms of their shape, width and height in such a way that the light emitted by the first semiconductor light-emitting elements 31 can be emitted directly only in an angle range of at most 65° and preferably of at most 45° measured with respect to the surface normal 41 of the first mounting faces 21, while light which is emitted at greater angles by the first semiconductor light-emitting elements 31 is shaded by the side faces. Furthermore, the side faces of the depressions in the first and/or second mounting side 11, 12 can also be designed to be reflective and in particular to have specular reflectivity. As an alternative to the exemplary embodiment shown, the side faces can also be inclined or at an angle to the mounting faces 21, 22, with the result that the light emitted laterally by the semiconductor light-emitting elements 31, 32 can be deflected in the direction of the respective main emission direction along the surface normals 41, 42.

The depressions in the second mounting faces 22 are embodied in the exemplary embodiment shown in such a way that all of the light or preferably light in the region of at most 90° relative to the surface normal 42 of the second mounting faces can be emitted without contact or direct incoming radiation onto the side faces. As a result, a homogeneous emission characteristic can be achieved for the second mounting side 12 embodied as indirect lighting in the exemplary embodiment shown.

The lighting device 100 in accordance with the exemplary embodiment shown can in particular meet the requirements in respect of no glare, direct and indirect lighting, high luminaire efficiency and utilization factor of the direct lighting and a compact design.

Furthermore, a structured cover disk and/or an optical diffuser can be arranged, for example, within the depressions or over the depressions and in particular also over the first and/or second mounting side 11, 12.

In the following figures, modifications of the exemplary embodiment shown in FIGS. 1A to 1C are shown, with the result that the description below is restricted primarily to the differences with respect to the exemplary embodiment described in connection with FIGS. 1A to 1C.

Figure 2:
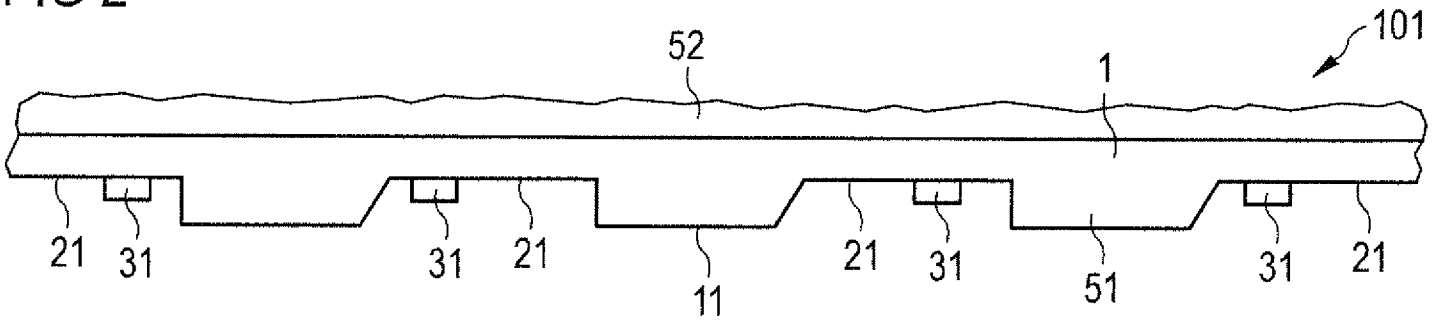

FIG. 2 shows part of a lighting device 101 which has first mounting faces 21 formed by depressions on a mounting side, in the exemplary embodiment shown of the first mounting side 11, the side faces of said mounting faces being in the form of reflectors. Furthermore, the first semiconductor light-emitting elements 31 are arranged in mutually different positions on the respective first mounting faces 21 within the respective depressions. As a result, an asymmetrical emission characteristic or a precise adjustment of the desired emission characteristic of the first mounting side 11 shown in the present case can be achieved, wherein, for this purpose, no additional optical components such as lenses or additional reflectors, for example, are required.

Figure 3B:
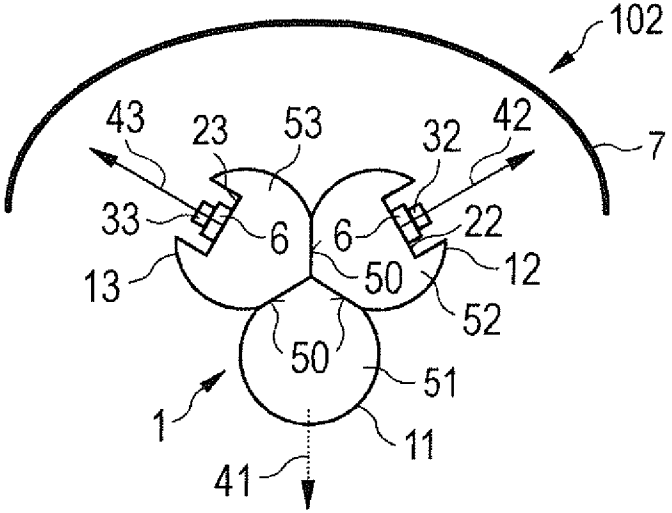
Figure 3A:
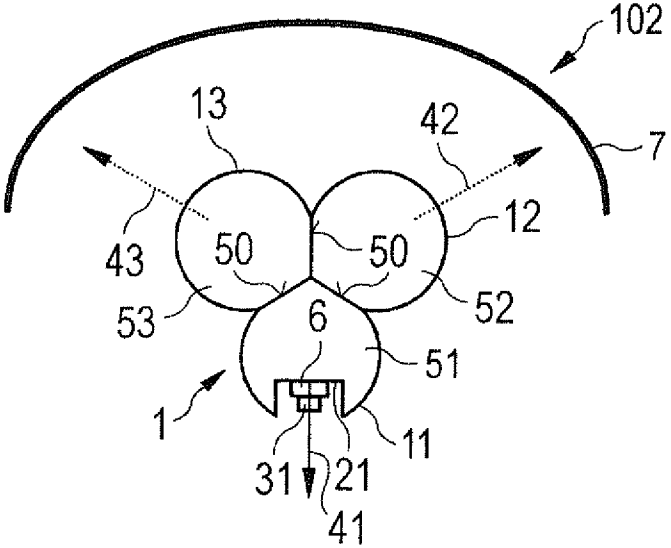

FIGS. 3A and 3B show a further exemplary embodiment of a lighting device 102, wherein FIGS. 3A and 3B each show sections along the main direction of extent 99 of the lighting device which correspond to the sections in FIGS. 1B and 1C.

The lighting device 102 has, in addition to the first and second mounting sides 11, 12, a third mounting side 13, wherein the first, second and third mounting sides 11, 12, 13 are arranged so as to face away from one another. In the exemplary embodiment shown, the surface normals 41, 42, 43 of the first, second and third mounting faces 21, 22, 23 of the first, second and third mounting sides 11, 12, 13, respectively, are arranged at an angle of approximately 120° with respect to one another. As an alternative to this, the second and third mounting sides 12, 13 can also be arranged in such a way that the second and third semiconductor light-emitting elements 32, 33 can emit at an angle of 0° to 45° with respect to a horizontal.

The carrier body 1 of the lighting device 103 of the exemplary embodiment shown in FIGS. 3A and 3B has three rod-shaped body parts 51, 52, 53, which each have a partially round cross section with flattened side faces 50, at which the body parts 51, 52, 53 are arranged against one another. First semiconductor light-emitting elements 31, which are in the form of warm-white-emitting LEDs, are arranged in the first mounting faces formed by depressions and arranged so as to be spaced uniformly apart from one another along the main direction of extent. The second and third semiconductor light-emitting elements 32, 33, which are arranged in the second and third mounting faces 22, 23, which are formed by depressions and are arranged along the main direction of extent of the lighting device 103 or the carrier body 1, each have clusters of blue, greenish-white and red LEDs. In this case, the second and third semiconductor light-emitting elements 32, 33 are each identical.

While the first semiconductor light-emitting elements 31 on the first mounting side 11 of the lighting device 103 are intended for direct lighting, the semiconductor light-emitting elements 32, 33 on the second and third mounting sides 12, 13 are intended for indirect lighting. By virtue of being formed as multicolored LED clusters, it is possible for the light color of the indirect lighting to be adjusted, for example, along the white curve of a Planckian black body radiator or else with different, adjustable color and light impressions. Optionally, it is possible to arrange a reflector, in particular a diffuse reflector, downstream of the second and third semiconductor light-emitting elements 32, 33, as is indicated by the reference symbol 7. As a result, thorough mixing of the light emitted by the second and third semiconductor light-emitting elements 32, 33 can be achieved.

As an alternative or in addition, the exemplary embodiments of the lighting devices shown in connection with FIGS. 1A to 3B also have further or other features in accordance with the embodiments described above in the general part.

The disclosure is not restricted by the description with reference to the exemplary embodiments to these exemplary embodiments. Instead, the disclosure includes any novel feature and any combination of features which in particular includes any combination of features in the patent claims, even if this feature or this combination itself is not explicitly specified in the patent claims or exemplary embodiments.

The invention claimed is:

1. A lighting device, comprising a rod-shaped carrier body with at least one first and one second mounting side and a main direction of extent, first semiconductor light-emitting elements on first mounting faces of the first mounting side, and second semiconductor light-emitting elements on second mounting faces of the second mounting side, wherein the first and the second mounting sides face away from one another, wherein the mounting faces are formed by a plurality of depressions in each of the mounting sides, which depressions are arranged so as to be spaced apart along the main direction of extent of each respective mounting side, and wherein the first semiconductor light-emitting elements are identical to one another and the second semiconductor light-emitting elements are identical to one another.

2. The lighting device according to claim 1, wherein the carrier body has at least two rod-shaped body parts, each having a partially round cross section and each having at least one flattened side, and the body parts are arranged with the flattened sides against one another.

3. The lighting device according to claim 1, wherein the semiconductor light-emitting elements are each arranged on a printed circuit board on the mounting faces.

4. The lighting device according to claim 1, wherein the semiconductor light-emitting elements on one mounting side are arranged in different positions on the respective mounting faces.

5. The lighting device according to claim 1, wherein the distances between the first mounting faces are equal to the distances between the second mounting faces, and the first and second mounting faces are arranged offset with respect to one another.

6. The lighting device according to claim 1, wherein the depressions in the first and/or second mounting faces have reflective side faces.

7. The lighting device according to claim 1, wherein the depressions in the first mounting faces have a shape, width and depth such that the light from the first semiconductor light-emitting elements is emitted at an angle of less than or equal to 65° with respect to the surface normal of the respective first mounting face during operation.

8. The lighting device according to claim 1, wherein the depressions in the second mounting faces have a shape, width and depth such that all of the light emitted by the second semiconductor light-emitting elements during operation is emitted directly.

9. The lighting device according to claim 1, wherein the depressions in the second mounting faces have a shape, width and depth such that the light is emitted by the second semiconductor light-emitting elements at an angle of less than or equal to 90° with respect to the surface normal of the respective second mounting face during operation.

10. The lighting device according to claim 1, wherein the first semiconductor light-emitting elements in each depression in the first mounting face and/or the second semiconductor light-emitting elements in each depression in the second mounting face each have precisely one light-emitting semiconductor chip.

11. The lighting device according to claim 1, wherein the first semiconductor light-emitting elements or the second semiconductor light-emitting elements each have a plurality of light-emitting semiconductor chips.

12. The lighting device according to claim 1, wherein the first and second semiconductor light-emitting elements emit light of different colors from one another.

13. The lighting device according to claim 1, wherein the carrier body has a third mounting side with third semiconductor light-emitting elements on third mounting faces formed by depressions and arranged along the main direction of extent, and the first, second and third mounting sides each face away from one another.

14. The lighting device according to claim 13, wherein the second and third semiconductor light-emitting elements have an identical design.

15. The lighting device according to claim 1, wherein a reflector is arranged downstream of the second mounting side in the emission direction of the second semiconductor light-emitting elements.

16. The lighting device according to claim 1, wherein each of the mounting faces is in the form of a depression with a planar base, wherein the planar bases of the first mounting faces are arranged parallel to one another and in one plane, and wherein the planar bases of the second mounting faces are arranged parallel and in one plane.

17. The lighting device according to claim 1, wherein the carrier body is designed as a heat sink for the semiconductor light-emitting elements mounted thereon and wherein the carrier body contains or is formed from metal comprising aluminum and/or copper.

18. The lighting device according to claim 1, wherein each mounting face has electrical connections for a semiconductor light-emitting element arranged on the mounting face and wherein the electrical connections are in the form of electrical contact faces, solder contacts or plug-type contacts.

19. The lighting device according to claim 1, wherein on each mounting side electrical feed lines interconnect the mounting faces on the respective mounting side, wherein the electrical feed lines are conductor tracks or cables on the surface or in the interior or in a combination thereof along the main direction of extent of the carrier body.

* * * * *